US010336515B2

(12) United States Patent
Rosson

(10) Patent No.: US 10,336,515 B2
(45) Date of Patent: Jul. 2, 2019

(54) SHORT ROTATION SAFETY LOCK FOR CONTAINERS AND BOTTLE FOR SAID LOCK

(71) Applicant: Eduardo Juan Rosson, Ciudad Autonoma de Buenos Aires (AR)

(72) Inventor: Eduardo Juan Rosson, Ciudad Autonoma de Buenos Aires (AR)

( * ) Notice: Subject to any disclaimer, the term of this patent is extended or adjusted under 35 U.S.C. 154(b) by 0 days.

(21) Appl. No.: 15/532,289

(22) PCT Filed: Dec. 1, 2015

(86) PCT No.: PCT/IB2015/059245
§ 371 (c)(1),
(2) Date: Jun. 1, 2017

(87) PCT Pub. No.: WO2016/088034
PCT Pub. Date: Jun. 9, 2016

(65) Prior Publication Data
US 2017/0327283 A1 Nov. 16, 2017

(30) Foreign Application Priority Data
Dec. 2, 2014 (AR) ..... 20140104487

(51) Int. Cl.
*B65D 50/04* (2006.01)
*B65D 39/12* (2006.01)
(Continued)

(52) U.S. Cl.
CPC ..... *B65D 50/04* (2013.01); *B65D 1/023* (2013.01); *B65D 39/12* (2013.01); *B65D 41/17* (2013.01);
(Continued)

(58) Field of Classification Search
CPC .... B65D 50/04–50/048; B65D 55/02–55/145; B65D 1/02–1/023; B65D 41/02–41/17
(Continued)

(56) References Cited

U.S. PATENT DOCUMENTS 34,976 A 4/1862 Nicholson
1,341,177 A 5/1920 Kaye
(Continued)

FOREIGN PATENT DOCUMENTS

AR 077902 A1 9/2011
AR 098591 A1 6/2016
(Continued)

OTHER PUBLICATIONS

The International Search Report dated Apr. 12, 2016; PCT/IB2015/059245.

*Primary Examiner* — Kareen K Thomas
(74) *Attorney, Agent, or Firm* — Ladas & Parry LLP

(57) ABSTRACT

A short rotation safety lock for containers has a fixed internal structure (1) linked to locking cap (3) and includes a clamping frame (12) that acts over an annular cordon or protrusion (61,62) of the container (6) of application. This internal structure (1) gives rotating assembly (4) to an external structure (2) which rotation movement, limited by a rotation limiter device (5), determines the movement of some mobile blocking members (24) between an active position behind said grip fingers (13) and a passive position in said intermediate spaces (14). In some variations a safety system of the kind of a seal that links the upper wall (23) of the external structure (2) with the internal structure (1) is incorporated. The detachable sector (70) acts as a safety seal and, even after the detachment, the link member (76)
(Continued)

maintains it as cover of the upper part of the lock. The bottle (200) has an annular entrance (204) compatible with the grip position of the safety lock.

25 Claims, 21 Drawing Sheets

(51) Int. Cl.
*B65D 45/32* (2006.01)
*B65D 55/02* (2006.01)
*B65D 1/02* (2006.01)
*B65D 41/17* (2006.01)

(52) U.S. Cl.
CPC ..... *B65D 45/32* (2013.01); *B65D 55/02* (2013.01); *B65D 55/024* (2013.01)

(58) Field of Classification Search
USPC ..... 220/200–380; 215/40–55
See application file for complete search history.

(56) References Cited

U.S. PATENT DOCUMENTS 2,483,055 A 9/1949 Krasberg
3,773,204 A 11/1973 Stroud
3,779,412 A * 12/1973 Kirton ..... B65D 50/041 215/206
3,893,582 A 7/1975 Kowalik
4,723,672 A * 2/1988 Puma ..... B65D 55/02 215/228
5,085,332 A 2/1992 Gettig et al.
5,269,429 A * 12/1993 Schumacher ..... B65D 51/002 215/249
5,421,469 A * 6/1995 Lee ..... B65D 51/002 215/247
5,890,610 A * 4/1999 Jansen ..... A61J 1/2089 215/253
5,957,314 A * 9/1999 Nishida ..... B65D 45/322 215/249
6,604,643 B1 * 8/2003 Michael ..... B65D 50/067 215/204
7,004,340 B2 * 2/2006 Belden, Jr. ..... B65D 55/14 215/215
8,333,288 B2 * 12/2012 Miller ..... B65D 3/04 215/211
8,544,665 B2 * 10/2013 Bogle ..... A61J 1/1406 215/201
8,562,582 B2 * 10/2013 Tuckwell ..... A61J 1/2096 138/162
8,950,609 B2 * 2/2015 Aneas ..... B65D 51/002 215/247
2010/0012615 A1 1/2010 Brooks
2012/0298613 A1 11/2012 Brooks

FOREIGN PATENT DOCUMENTS

FR 2684965 A1 6/1993
FR 2907765 A1 5/2008
WO 03/037738 A1 5/2003
WO 2011/022756 A1 3/2011

* cited by examiner

SHORT ROTATION SAFETY LOCK FOR CONTAINERS AND BOTTLE FOR SAID LOCK

FIELD OF THE INVENTION

This invention relates to the field of different industrial techniques and, among them, to locks for containers.

More particularly, it refers to a short rotation safety lock for containers that, based on a rotating assembly and on a rotation limiter device, allows the closing or opening through a simple and brief rotating movement of its external structure regarding its internal structure, with the possibility of using a safety device that maintains it sealed until used. The invention also refers to a bottle specifically adapted for above-mentioned lock.

PRIOR ART

At present many means for closing containers are known.

For example, the closure disclosed in patent document U.S. Pat. No. 3,773,204 which shows a locking system and a specific container that work associated, is known. The system works in a rotating manner and has grip members and an end with a forced rubbing cam. The inner part only closes the opening of the container, but lacks a press-on cap that immobilizes it. Therefore, in order that the external part can rotate, it requires the assistance of both user hands simultaneously pressing over the container, as it is explained in the description of its procedure. This fact also evidences that there is a necessary relation between the lock and the container and that, mainly, it refers to a system that prevents the accidental opening of the container. Furthermore, the absence of a cap that works in association with the internal structure makes it not applicable to containers' necks such as bottles that contain liquids, in general, and soft drinks, in particular.

Patent document U.S. Pat. No. 2,483,055 shows another rotating system with an lower cover fitted with a set of clamping fingers and an upper cover with a set of locking fingers. It lacks a clamping frame and a cap that fits forced into the mouth of the container.

Other rotating locks can be found in patent documents US 34976 and U.S. Pat. No. 1,341,177 wherein we can find devices with locking means over which sliding cams work forcibly.

There also other known devices which mechanisms work with axial or axial and rotating movements. For example, document WO03037738 shows an external cover provided with cams that work over clamping fingers that fit into the neck. In this case the lock works combining a rotating movement with an axial vertical movement.

In documents U.S. Pat. No. 3,893,582, US 20120298613, WO 2011022756 and AR 07702A1, there is a system of fingers embracing the neck and a cam system, which are fitted with protrusions over which the nails or locking members act. It works combining a rotating movement with an axial vertical movement.

Document FR 2684965 shows a system that combines a rotating movement with an axial displacement through the use of a thread.

In other devices, the locking closure is produced by axial vertical displacement of a lock, which is mounted over a plurality of members or elastic fingers that fit into one entrance of the neck. Such are the cases, for example, of the closures disclosed by documents US 20100012615 and U.S. Pat. No. 5,085,332.

Advantages and Purposes

One of the purposes of this invention is to provide a lock means that can be easily handled and that, with a brief rotating movement, can be opened or closed.

Another purpose is that it cannot only be provided applied to the commercialization of full containers—for example, beverages—but also that it can be reused to preserve the part of the content that is not initially consumed or also reused applying it to other containers to preserve their content.

A further purpose is to provide a closure means that can be commercialized independently from the container, in such a way that the consumer can reuse it as many times as necessary.

A further purpose is to provide a closure means that can be applied to the sale of full containers, in combination with a safety seal that guarantees the status of its content. An advantage of this safety lock is that it can be operated with only one hand, without efforts and with minimum movements.

Another advantage is that it works with brief rotating movements, without the need to use axial vertical forces that, many times and especially in the case of bottles, can cause imbalances and the slipping, falling and breaking of the container.

Another advantage is its versatility since it can be used both as the closure provided with packaged goods—with or without seal—and as an independently sold item to preserve the content of containers that are provided with conventional closure means, such as covers, caps, corks, etc.

Another advantage is its great adaptive capacity to different production necessities, due to the fact that its mechanism allows multiple variations regarding the placement of the rotating assembly and the rotation limiter device, in different places of its structures, separated, adjacent, combined, etc.

Another advantage is that the link between the internal structure, the cap and the external structure form an extremely strong, simple and efficient mechanism that eases the operation among the different component parts.

Another advantage is the small quantity of component parts, quality that highlights if it is compared with the majority of known locks used in similar functions.

Another advantage of the component pieces is their constituent simplicity which makes them very easy to produce and at an extremely lower cost.

A further advantage is that, the few component pieces and its simplicity, allow their manufacture through an extremely simple assembly procedure.

Another advantage of the production procedure is that it allows the mass manufacture of great quantities of this lock, which has a favorable impact on the reduction of costs per unit.

DRAWINGS

For better clarity and understanding of the object of the invention, it is illustrated with several figures where it has been represented in one of its preferred embodiments, everything as an illustrative example, without limitation:

FIG. 1, includes drawings A and B, being:

Drawing A, a longitudinal cut of an exploded internal perspective of the safety lock without safety device and Drawing B, a longitudinal cut of an exploded internal perspective of present safety lock in an embodiment in which it includes a safety device, with unidirectional rotation mechanism and sealing means with a detachable sector and a link member that is projected from the internal structure.

FIG. 2, includes drawings A and B, being:

Drawing A, an exploded perspective view of present lock without safety device and Drawing B, an exploded perspective view of present lock with safety device with. unidirectional rotation mechanism and sealing means.

FIG. 3, includes drawings A and B, being:

Drawing A, a previous view of a longitudinal cut of an exploded internal perspective of present lock without safety device and Drawing B, a back view of a longitudinal cut of an exploded external perspective of the safety lock of drawing A.

FIG. 4, includes drawings A and B, being:

Drawing A, a previous view of a longitudinal cut of an exploded internal perspective of present lock with safety device that includes an unidirectional rotation mechanism and sealing means and Drawing B, a back view of a longitudinal cut of an exploded internal perspective of present lock of drawing A.

FIG. 5, includes drawings A and B, being:

Drawing A, a lower perspective view that shows the grip fingers that are released when facing the straight edges unblocking cavities and Drawing B, a lower perspective view that shows the grip fingers blocked by the mobile blocking members.

FIG. 6, includes drawings A and B, being:

Drawing A, a lower perspective view, that shows the grip fingers that are released when facing the chamfered edges unblocking cavities and Drawing B, a lower perspective view that shows the grip fingers blocked by the mobile blocking members.

FIG. 7, includes drawings A and B, being:

Drawing A, a previous view of a longitudinal cut of an internal exploded view of present lock with safety device that includes an unidirectional rotation mechanism and sealing means and Drawing B, a lower perspective view of the upper wall and an upper perspective view of the internal structure, in which central part it can be seen how the link member is projected.

FIG. 8, includes drawings A, B, C and D, being:

Drawing A, an upper perspective view of present lock with safety device;

Drawing B, a longitudinal cut of present lock that allows the appreciation of the link between the upper wall, the detachable sector, the unidirectional rotation mechanism and the link member that is projected from the internal structure;

Drawing C, an upper perspective view that shows the sinking of the detachable sector below the upper wall and the extremity of the link member and Drawing D, a longitudinal cut of present lock that allows the appreciation of the dissociation between the upper wall and the detachable sector that remains sunken.

FIG. 9 is a longitudinal cut of present lock in an embodiment without safety device FIG. 10 is a longitudinal cut that shows the constitution and mobility of a device of prior art.

FIG. 11 includes drawings A, B, C and D, in which an arrangement sequence of present lock without safety device is shown, being:

Drawing A, a longitudinal cut that shows the positioning of arrangement in the container mouth;

Drawing B, another longitudinal cut where it can be seen how the grip fingers elastically yield to surpass the position of the annular cordon and how the cap enters into the container;

Drawing C, another longitudinal cut where it can be seen how the cap fully penetrates and the grip fingers are placed behind the annular cordon of the container and Drawing D, another longitudinal cut where it can be seen how the rotating movement of the external structure makes the mobile blocking members be placed behind the grip fingers, preventing safety lock from going out.

FIG. 12 is a longitudinal cut that allows the appreciation of the present lock without safety device installed and hold to the annular cordon of a container.

FIG. 13 is a longitudinal cut that allows the appreciation of present lock without safety device installed and hold to an annular protrusion of a container.

FIG. 14 is a lower view, in elevation, in which the action of the mobile blocking members over the grip fingers is represented.

FIG. 15 is a lower view, in elevation, in which an embodiment with the grip fingers chamfered to allow a better operation of the mobile blocking members is represented.

FIG. 16, includes drawings A and B, being:

Drawing A, a transversal cut of the safety lock in passive position, with the grip fingers released and Drawing B, a transversal cut of the safety lock in active position, with the grip fingers blocked.

FIG. 17, includes drawings A, B and C, being:

Drawing A, a lower perspective view of the upper wall of the external structure;

Drawing B, a lower perspective view of the internal structure with the upper wall on top and Drawing C, an upper perspective view of the internal structure assembled in the external structure, without the upper wall.

FIG. 18 is a perspective view of the internal structure, in one of its embodiments. Details such as elasticity weakening behind the upper members can be observed.

FIG. 19 includes drawings A, B, C, D, E, F, G, H and I, that show several variations of forced couplings of positional fastening and of the ends of the rotation limiter device, being:

Drawing A, a partial longitudinal cut in which the fixed forced couplings can be observed in the upper wall and the fixed ends can be observed in the upper edge of the external body;

Drawing B, another partial longitudinal cut in which the fixed forced couplings and the fixed ends can be observed in the upper wall;

Drawing C, another partial longitudinal cut in which the fixed forced couplings and the fixed ends can be observed in the upper edge of the external body;

Drawing D, another partial longitudinal cut in which the fixed forced couplings can be observed in the upper edge of the external body and the fixed ends can be observed in the upper wall.

Drawing E, another partial longitudinal cut in which the fixed forced couplings can be observed in the upper edge of the external body and in the upper wall and the fixed ends can be observed in the upper edge of the external body;

Drawing F, another partial longitudinal cut in which the fixed forced couplings can be observed in the upper edge of the external body and in the upper wall and the fixed ends can be observed in the upper wall;

Drawing G, another partial longitudinal cut in which the fixed forced couplings can be observed in the upper edge of the external body and in the upper wall (upside down regarding drawing E) and the fixed ends can be observed in the upper edge of the external body.;

Drawing H, another partial longitudinal cut in which the fixed forced couplings can be observed in the upper edge of the external body and in the upper wall (upside down regarding drawing F) and the fixed ends can be observed in the upper wall and Drawing I, another partial longitudinal cut in which the fixed forced couplings of double effect can be observed in the upper edge of the external body and in the upper wall and the fixed ends can be observed in the upper wall and in the upper edge of the external body.

In all above-mentioned drawings of FIG. 19, the corresponding disposition of the mobile forced couplings can be seen in the extremities of the upper members.

FIG. 20 is a partial longitudinal cut of present lock, in an embodiment in which the rotating assembly is in an intermediate part between the external body and the internal body.

FIG. 21, includes drawings A, B, C, D and E, being:

Drawing A, a schematic representation in which the rotation sliders are horizontal and are placed in the upper part of the safety lock;

Drawing B, another schematic representation in which the rotation sliders are horizontal and are placed in an intermediate part of the safety lock;

Drawing C, another schematic representation in which the rotation sliders are inclined and are in an intermediate part of the safety lock;

Drawing D, another schematic representation in which the rotation sliders are inclined and extend between the upper part and the intermediate part of the safety lock and Drawing E, another schematic representation in which the rotation sliders are horizontal and are in the lower part of the safety lock.

FIG. 22 is a partial longitudinal cut in an exploded perspective of present safety lock, in an embodiment in which both the rotating assembly and the rotation limiter device are in an intermediate part thereof.

FIG. 23 is a detail of a perspective view corresponding to the rotating assembly and the rotation limiter device placed in the upper edge of the external body.

FIG. 24, includes drawings A, B and C, being:

Drawing A, a previous view of a longitudinal cut of an internal exploded perspective of present lock with a safety device in which the link member is projected from the detachable sector of the upper wall;

Drawing B, a back view of a longitudinal cut of an external exploded perspective of the lock of drawing A and Drawing C, an exploded perspective view of the device of drawing A that allows the observation of details of the component parts.

FIG. 25, includes drawings A, B, C and D, being:

Drawing A, a longitudinal cut of the external structure of present lock, in the same embodiment as shown in FIG. 24;

Drawing B, a longitudinal cut of the internal structure of the lock of FIG. 24;

Drawing C, a longitudinal cut of the lock of FIG. 24, with the structures of drawings A and B assembled to each other, and Drawing D, a longitudinal cut of the lock of drawing C, with the detachable sector being sunken.

FIG. 26, includes drawings A, B, C and D, being:

Drawing A, a lateral view, in elevation, of a bottle with flat cordon;

Drawing B, a lateral view, in elevation, of a bottle with annular entrance between the cordon and the opening;

Drawing C, a longitudinal cut of a bottle such as the one of drawing B with the present lock being applied and Drawing D, a longitudinal cut of a bottle of the conventional type with the present lock being applied.

In the different figures, the same numbers and/or reference letters indicate equal or corresponding parts.

LIST OF THE MAIN REFERENCES (1) Internal structure.
(2) External structure.
(3) Cap.
(4) Rotating assembly.
(5) Rotation limiter device.
(6) Application container.
(7) Safety device.
(10) Internal body [of the internal structure (1)].
(10*a*) Supporting central body [assembled in the internal body (10)].
(11) Retentive supporting members.
(12) Clamping frame.
(13) Grip fingers.
(14) Intermediate spaces [between the grip fingers (13)].
(15) Upper members.
(16) Extremities of the upper members (15).
(20) External body [of the external structure (2)].
(21) Upper edge of the external body (20).
(22) Lower edge of the external body (20).
(23) Upper wall or lock of the external structure (2).
(24) Mobile blocking members.
(25) Unblocking cavities.
(30) Cap shutter (3).
(31) Expansion cavity.
(32) Lower opening.
(33) Internal lock.
(34) Gas passage.
(40) Fixed sliders of the rotating assembly (4).
(41) Mobile sliders of the rotating assembly (4).
(50) Fixed ends of the rotation limiter device (5).
(51) Mobile ends of the rotation limiter device (5).
(52) Fixed forced coupling [positional fastening means].
(53) Mobile forced coupling [positional fastening means].
(60) Container body (6).
(61) Annular cordon.
(62) Annular protrusion.
(63) Container opening (6).
(64) Container cavity.
(70) Detachable sector.
(71) Sectorial weakening.
(72) Central weakening.
(73) Unidirectional rotation mechanism.
(74) Upper tooth of the mechanism (73).
(75) Lower tooth of the mechanism (73).
(76) Link member.
(77) Sinkable extremity of the link member (76).
(78) Sinking opening of the extremity (77).
(80) Upper coupling [in the upper wall (23) to couple with the external structure (2)].
(81) Lower coupling [in the external structure (2) to couple with the upper wall (23)].
(130) Chamfered contact wall of the grip fingers (13).
(150) Elasticity weakening of the upper members (15).

(200) Bottle.
(201) Neck.
(202) Discharge mouth.
(203) Cordon.
(204) Entrance of the annular clamping.

DESCRIPTION OF DRAWINGS

In general terms, the present inventions consists of a short rotation safety lock for containers wherein a fixed internal structure (1) linked to a closure cap (3), includes a clamping frame (12) that acts over an annular cordon or protrusion (61,62) of the application container (6). This internal structure (1) gives rotating assembly (4) to an external structure (2) which rotation movement, limited by a rotation limiter device (5), determines the movement of some mobile blocking members (24), between an active position behind said grip fingers (13) and a passive position in said intermediate spaces (14). In some variations, a safety device (7) having a unidirectional rotation mechanism (73) that links the internal structure (1) with a detachable sector (70) of the external structure (2) is included.

DETAILED DESCRIPTION

Figure 1:
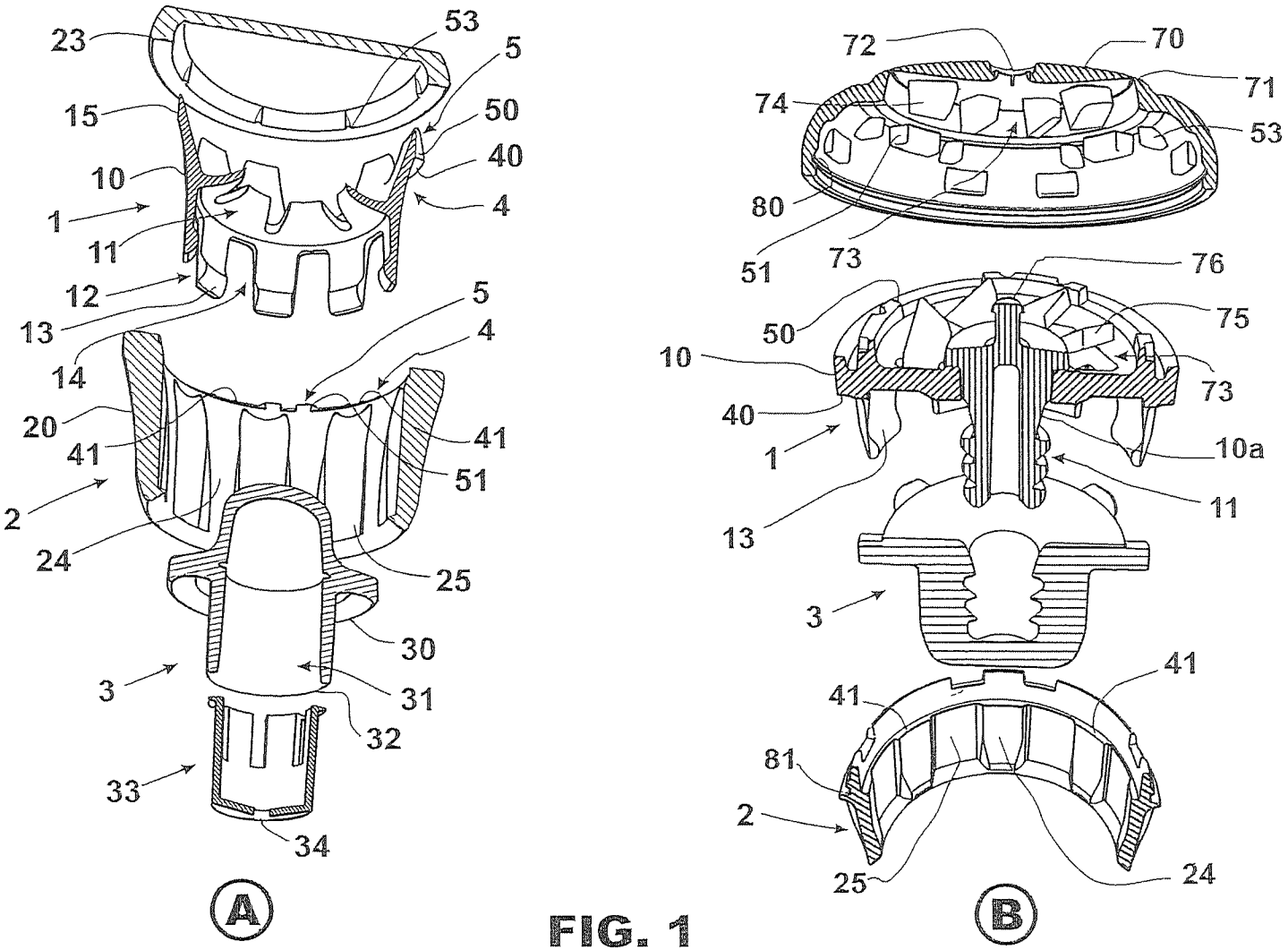
Figure 2:
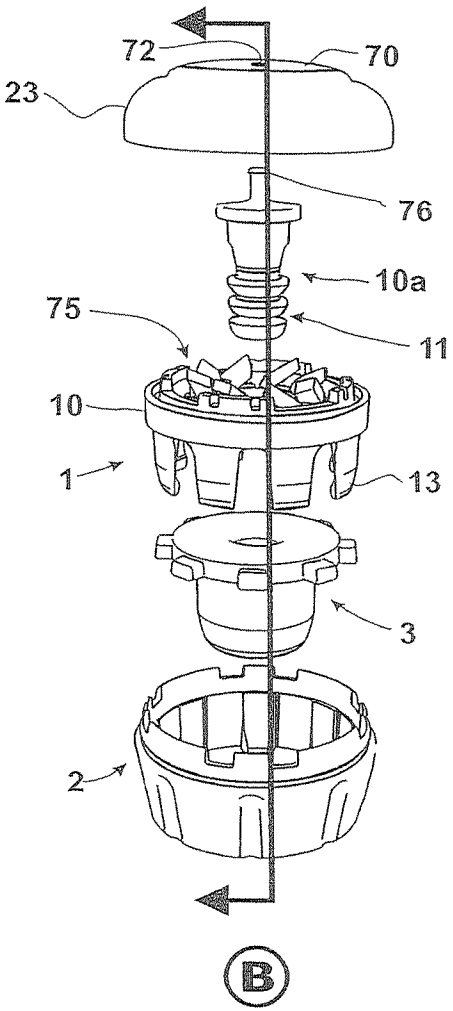
Figure 2:
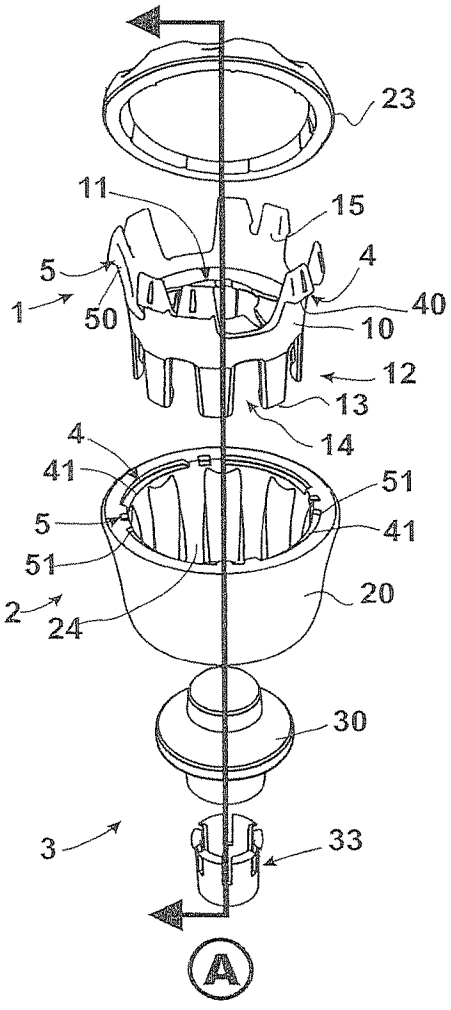
Figure 3:
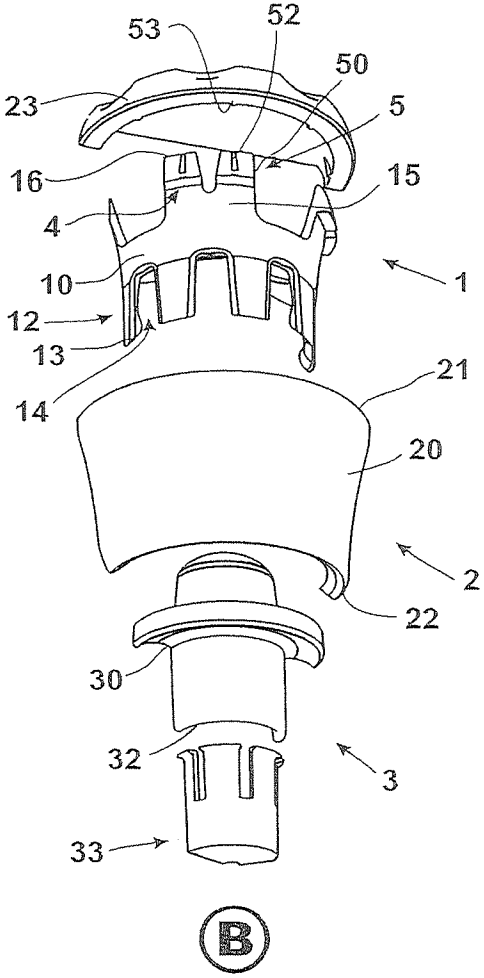
Figure 4:
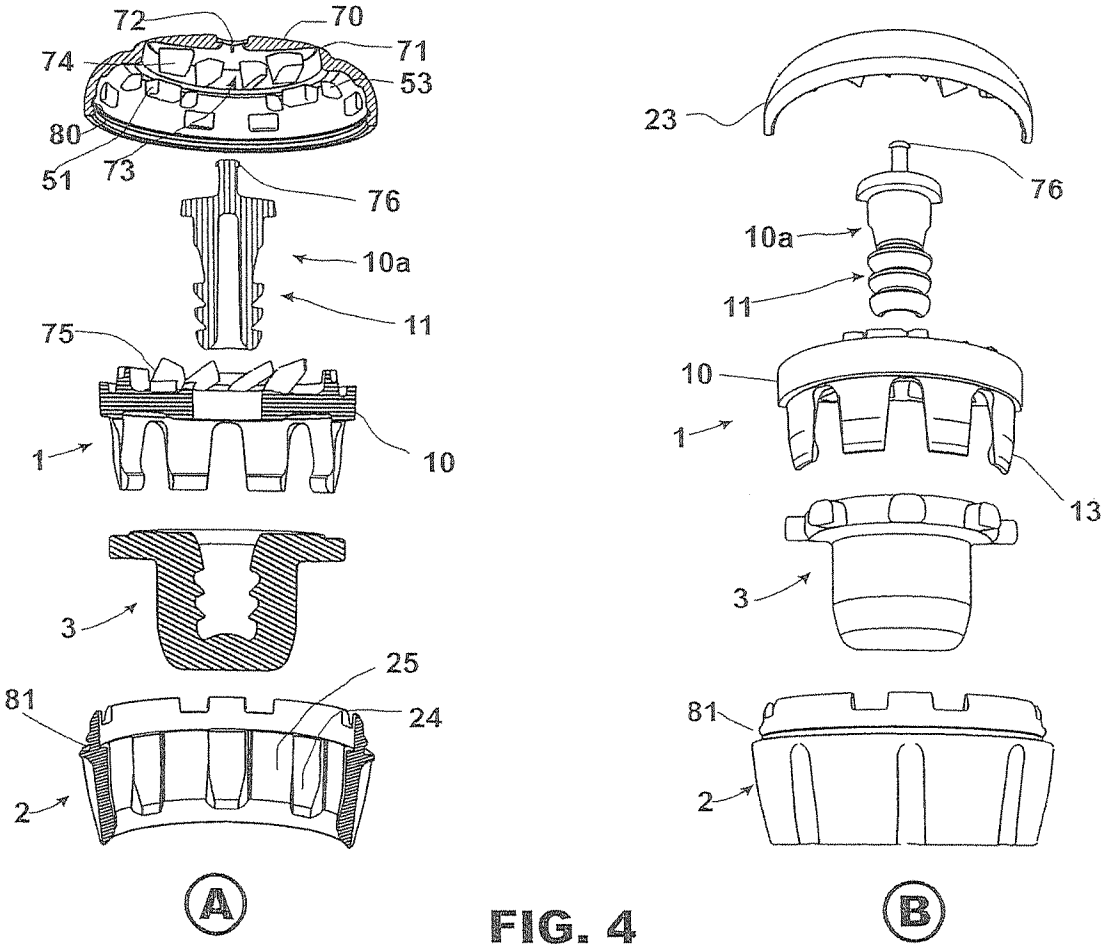
Figure 5:
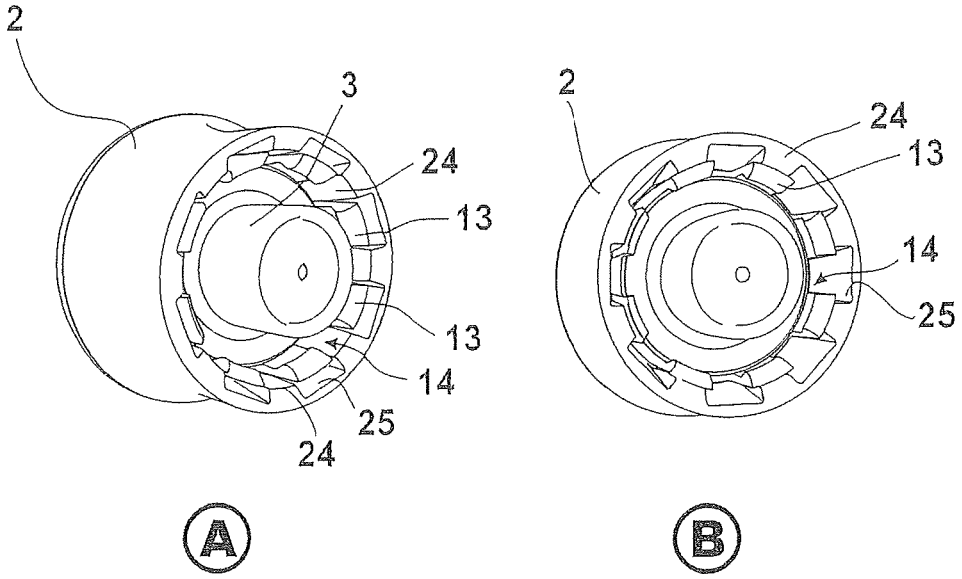
Figure 6:
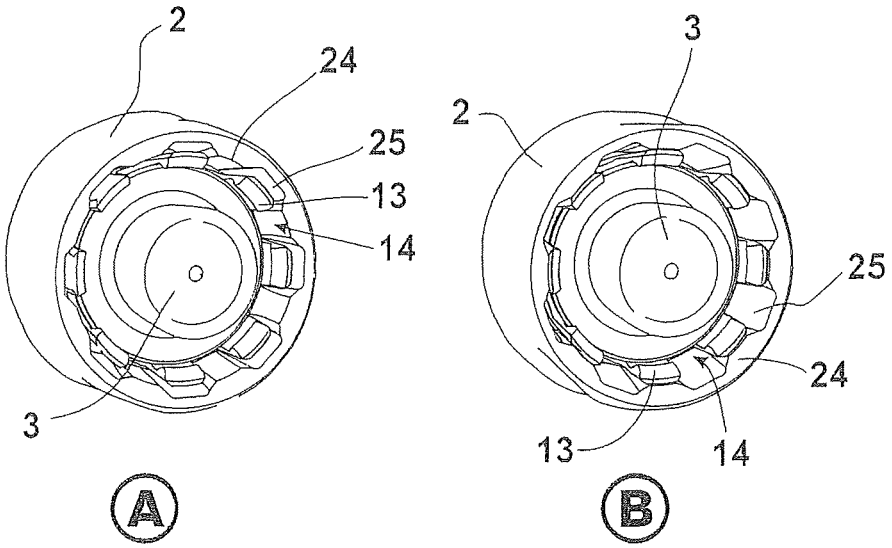
Figure 7:
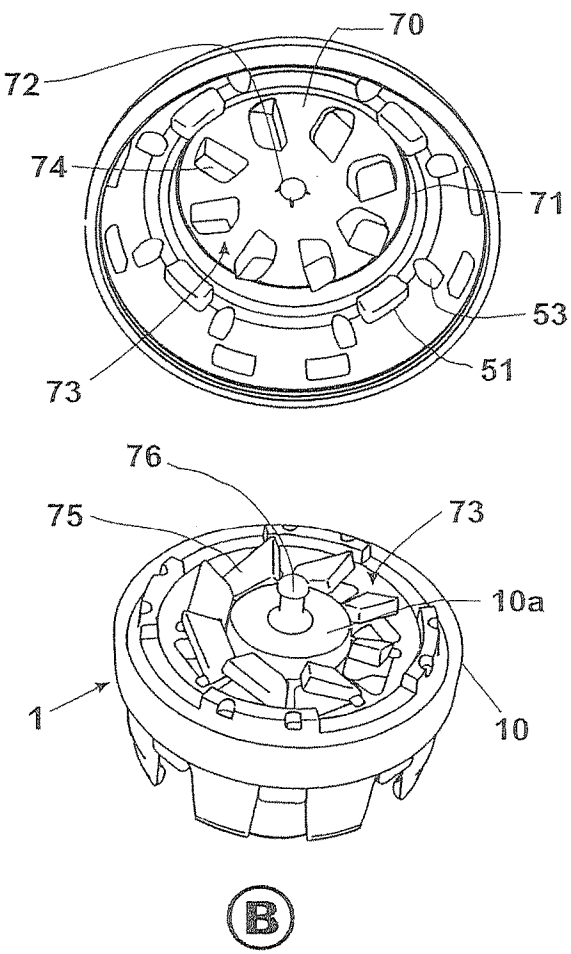
Figure 7:
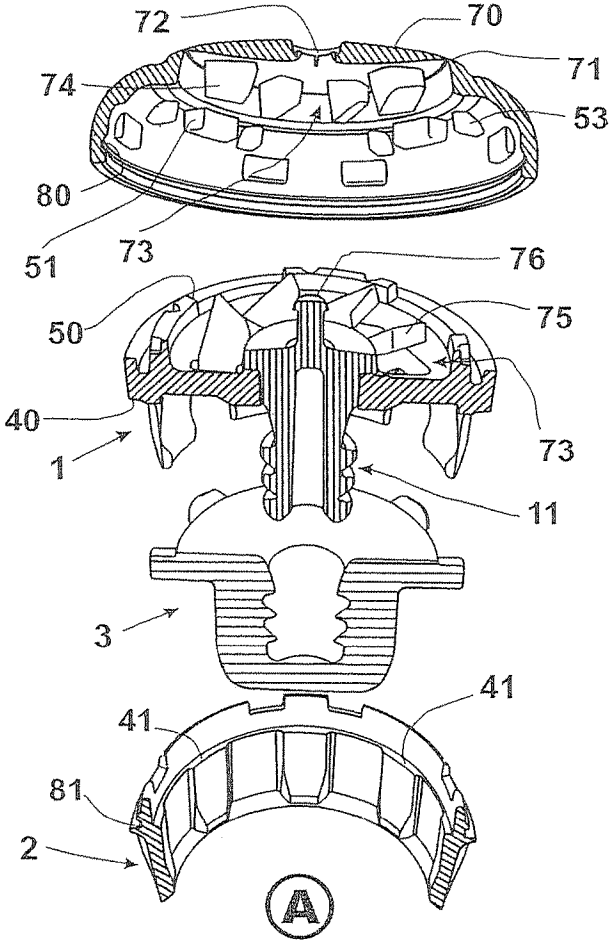
Figure 8:
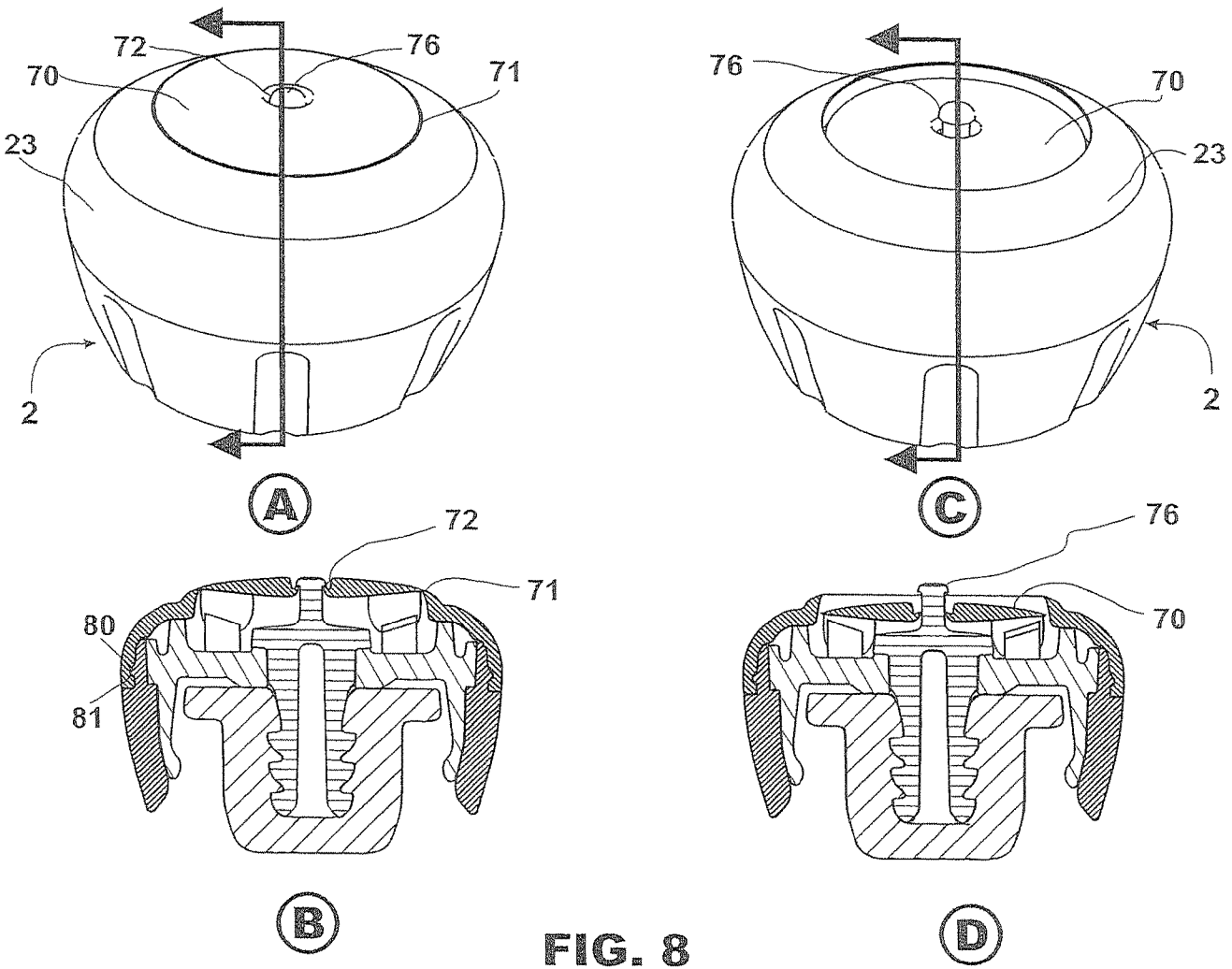
Figure 9:
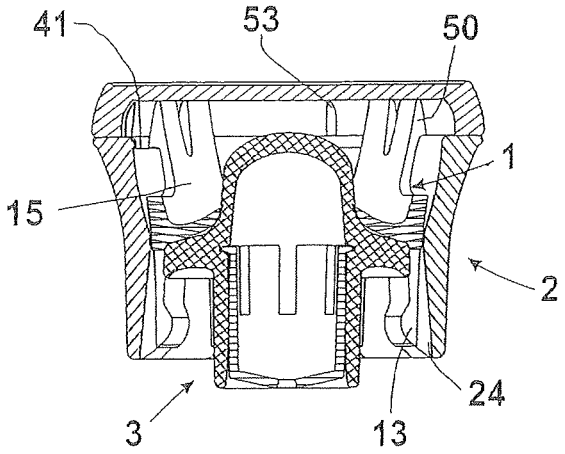
Figure 10:
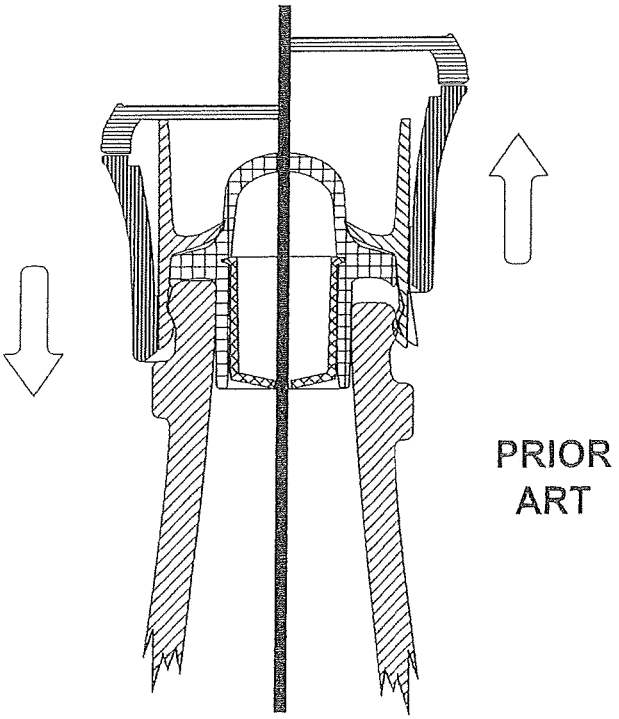
Figure 11:
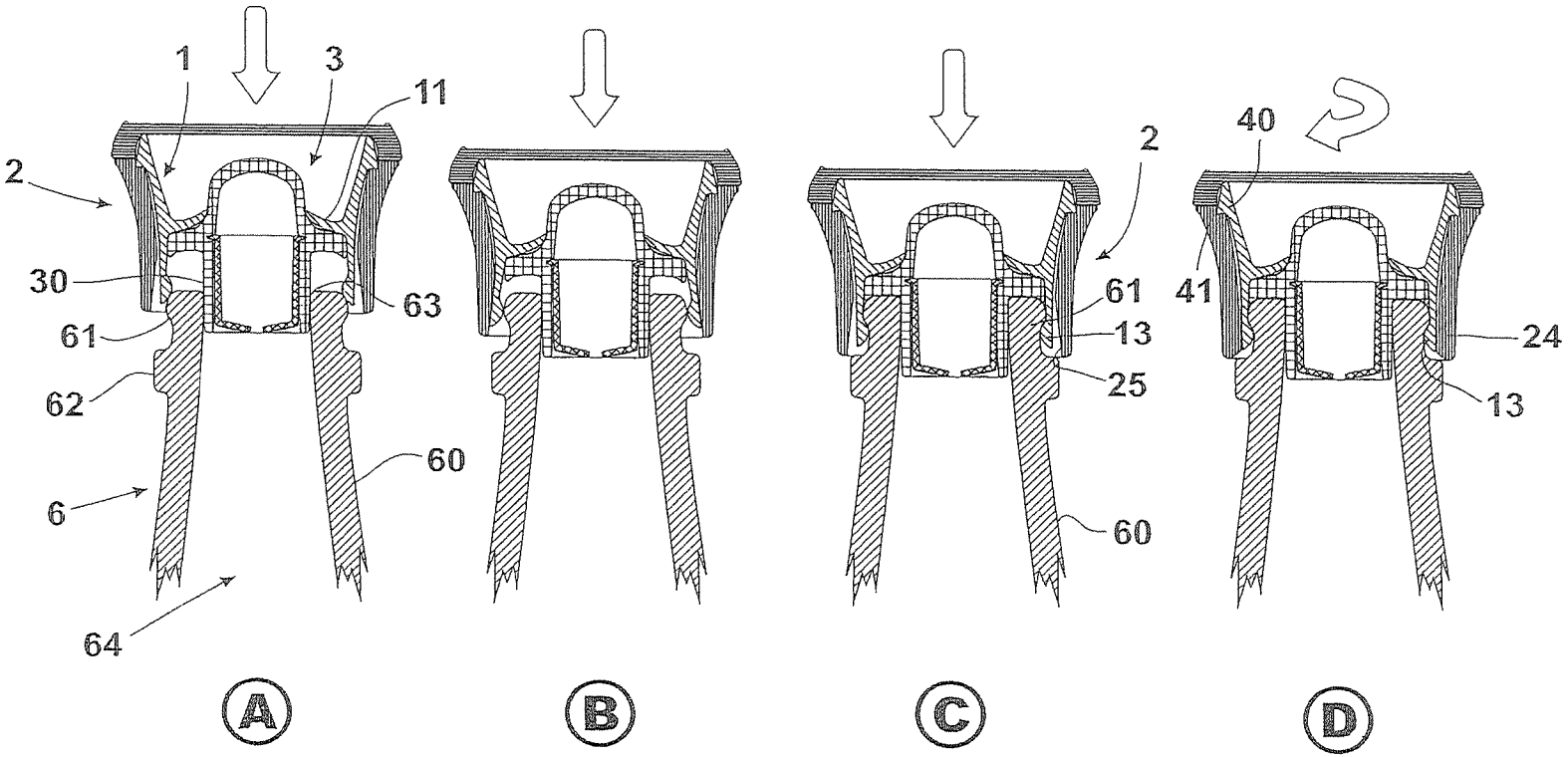
Figure 12:
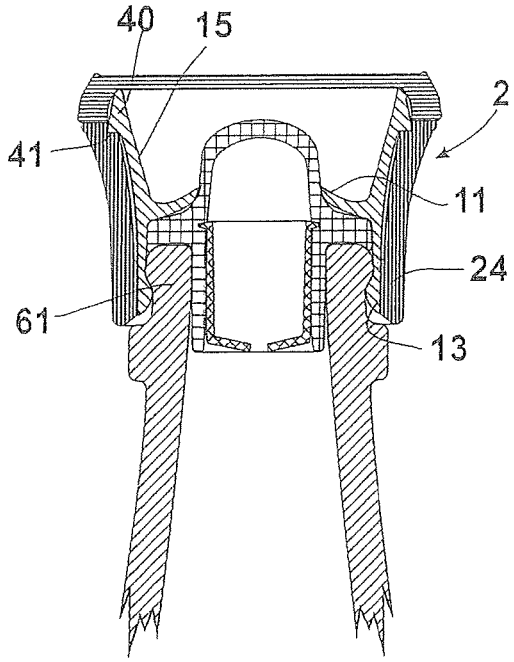
Figure 13:
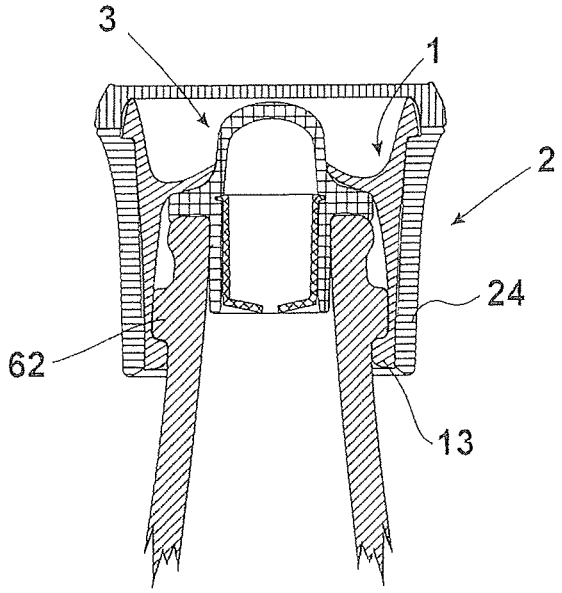
Figure 14:
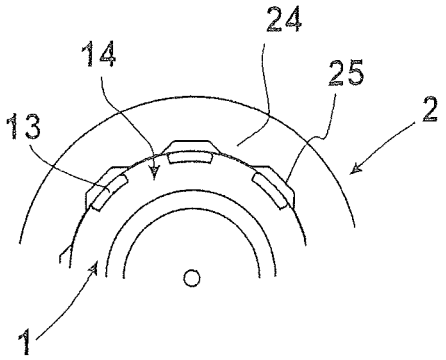

More particularly, present safety lock may be applied to different containers (6)—such as bottles, jars, pots, containers in general—around which opening there are protrusions such as an annular cordon (61), an annular protrusion (62) o the like.

In one embodiment, the safety lock includes a supportive internal structure (1) linked to a cap (3) placed in its central part. This cap (3) forcibly fits into the opening of the container (6), closing the access to the container cavity (64) thereof. In different variations, said cap (3) can be, totally or partially, composed of its own internal structure (1) o even be assembled in this last one through some retentive supporting members (11).

Different variations regarding the mentioned cap (3) have also been foreseen. In one of them, it includes a shutter (30) which hollow body is projected forming an expansion cavity (31). Through the lower opening (32) of said expansion cavity (31), there is an internal lock (33), that can be provided with one or more gas passages (34) that, eventually, come from the container content (6). In this way, the pressure of this gas is used to exert an expansive and contributing influence with the function of the cap lock (3).

As this last one is linked to the internal structure (1), it is arranged around the opening (63) of the container (6) in such a manner that the clamping frame (12) is projected over the adjacent area to said opening (63), where the annular cordon (61) or other protrusions of the container (6) are usually found.

The clamping frame (12) includes a plurality of grip fingers (13)—two or more—that form said clamping frame (12), alternating with intermediate spaces (14). It has been foreseen that the grip fingers (13) elastically yield in such a way that, if normally closed, they do not impede the fitting of the clamping frame (12) in the annular cordon (61) or annular protrusion (62). This is also valid for the case in which they are normally opened, since their elasticity will allow the action of the external structure (2).

On the other hand, the external structure (2) includes an external body (20) that, while its upper edge (21) ends closed through an upper wall (23), is internally provided with a plurality of mobile blocking members (24) among which a plurality of unblocking cavities (25), also mobile, are inserted. Underneath these means, the mentioned external body (20) ends in a lower edge (22) that surrounds the adjacent opening.

When the external structure (2) is assembled in the internal structure (1), the external body (20) surrounds the internal structure (1) in such a way that the blocking members (24) and the unblocking cavities (25) remain adjacent to the grip fingers (13) and to the intermediate spaces (14). It has been foreseen that the dimensions of the unblocking cavities (25) be the appropriate ones to allow the complete retraction of the grip fingers (13), when these last ones face the maximum protrusion of the annular cordon (61) or of the annular protrusion (62).

Figure 17:
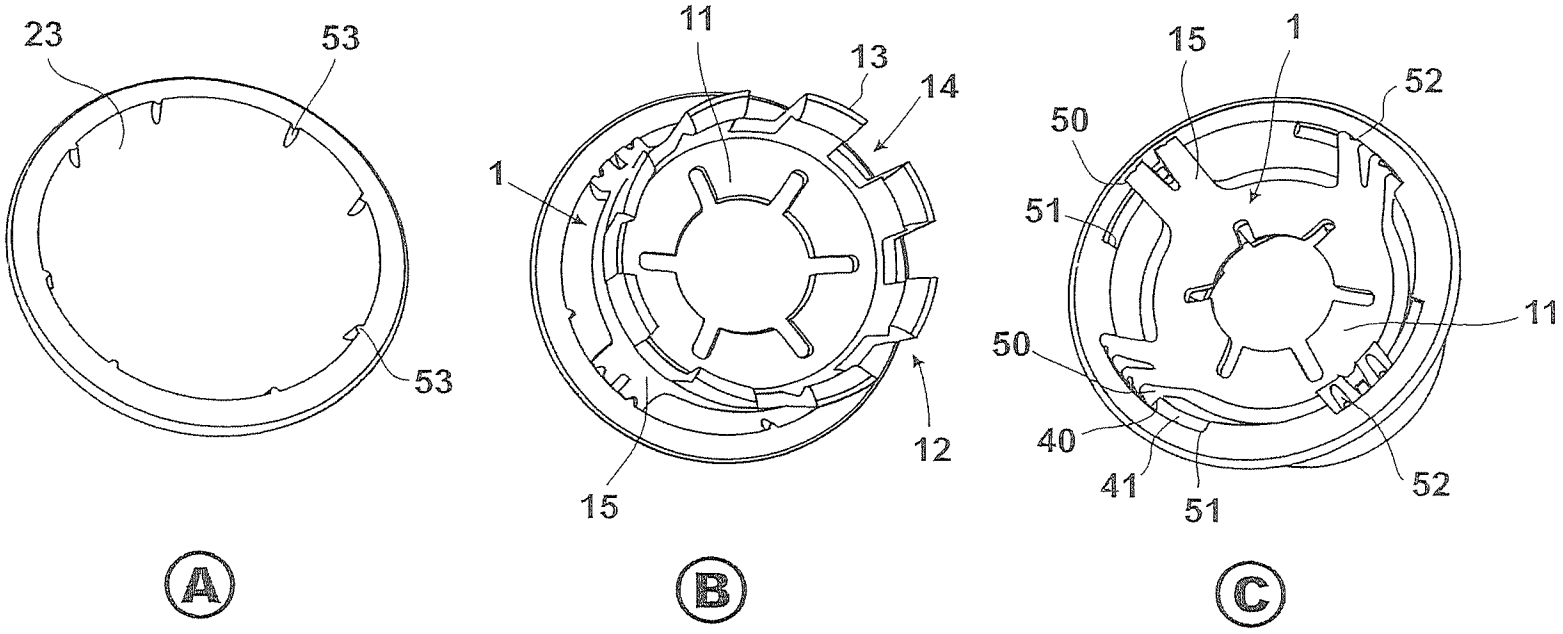
Figure 18:
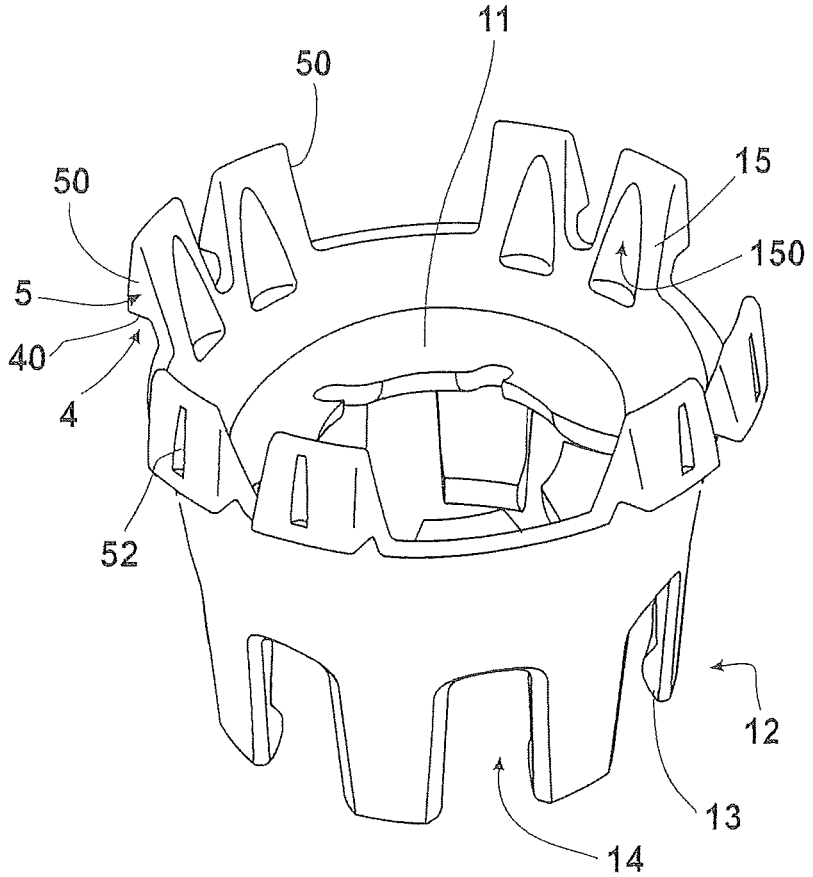
Figure 19:
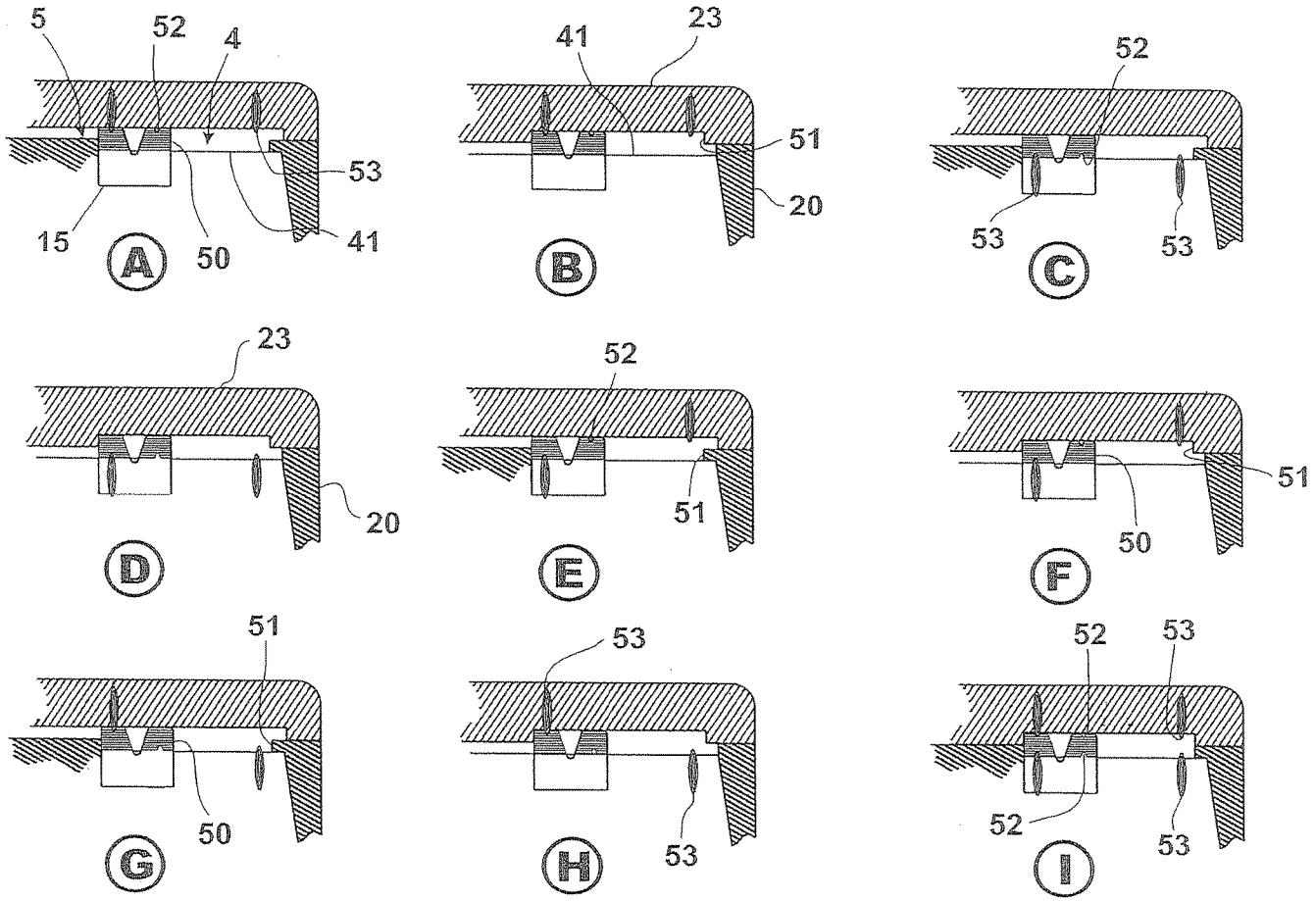
Figure 20:
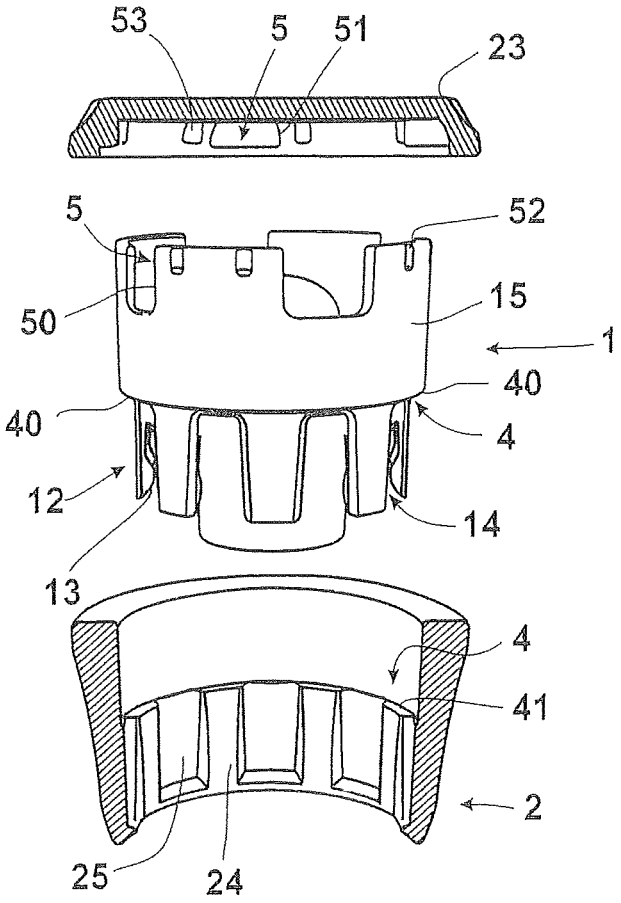
Figure 21:
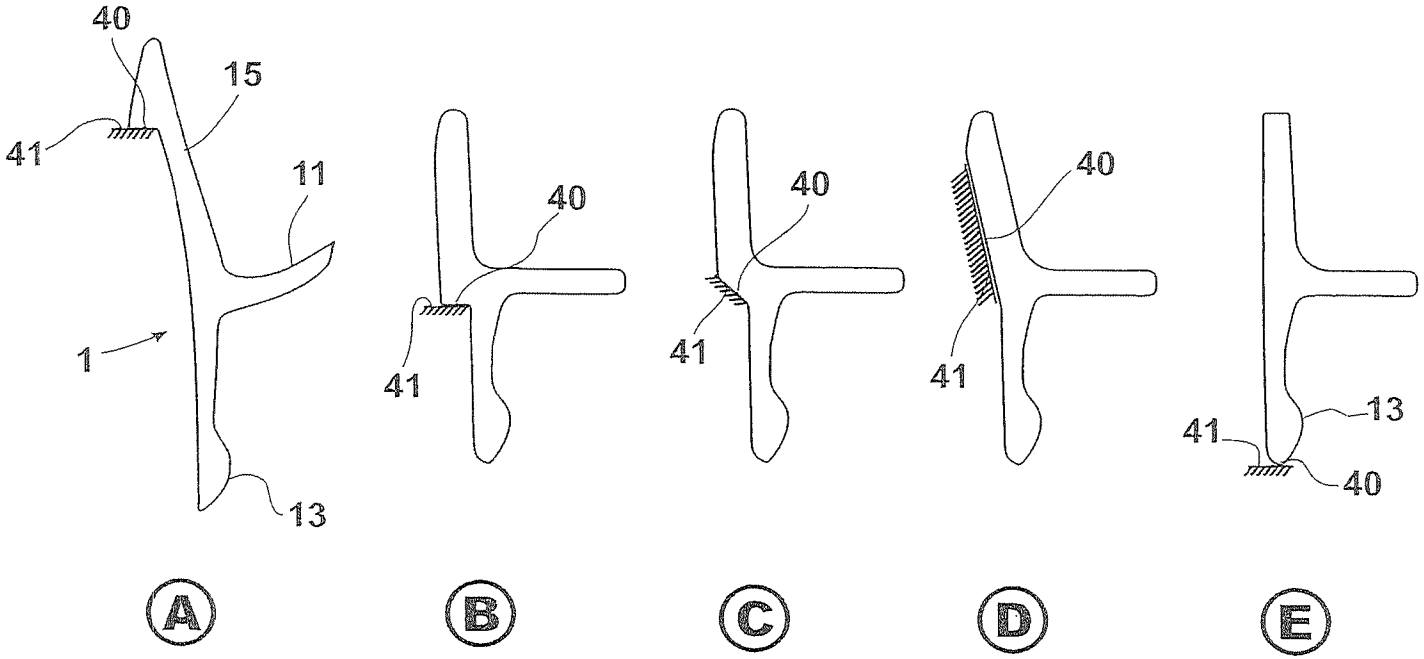
Figure 22:
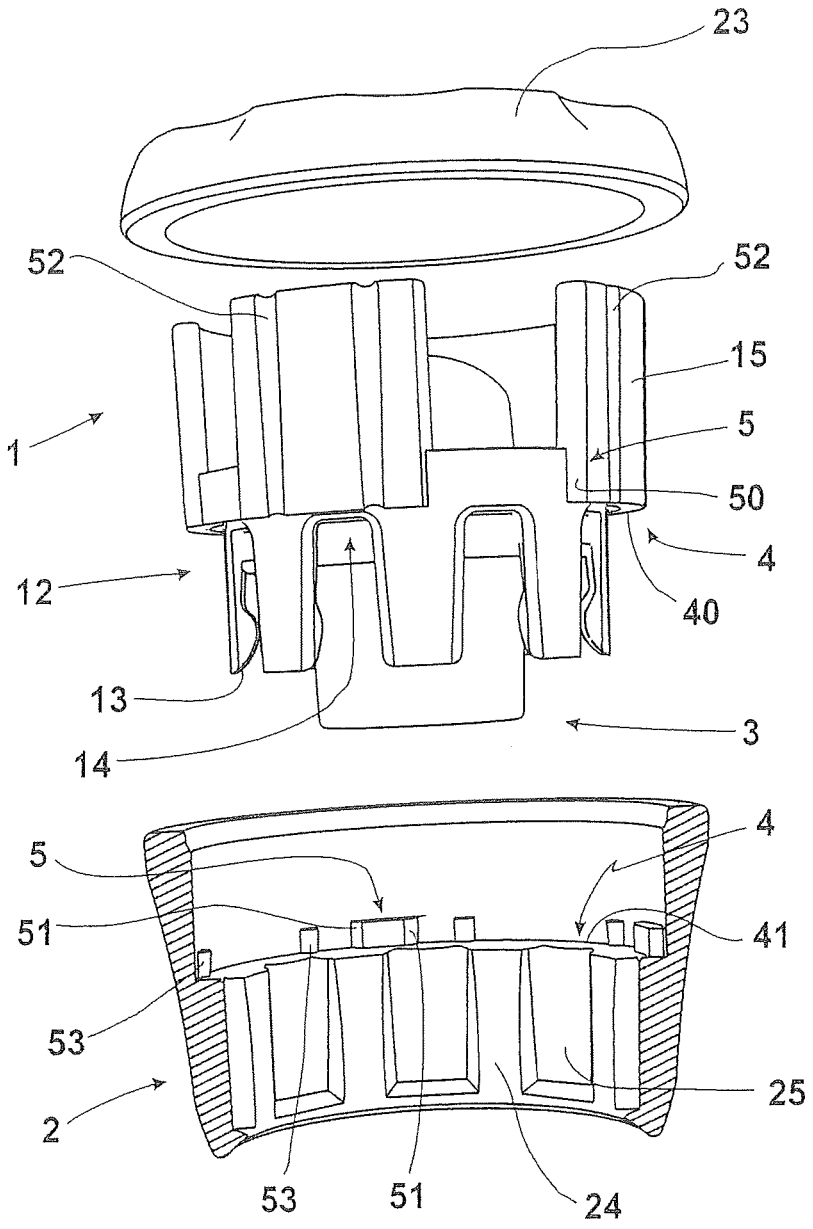
Figure 23:
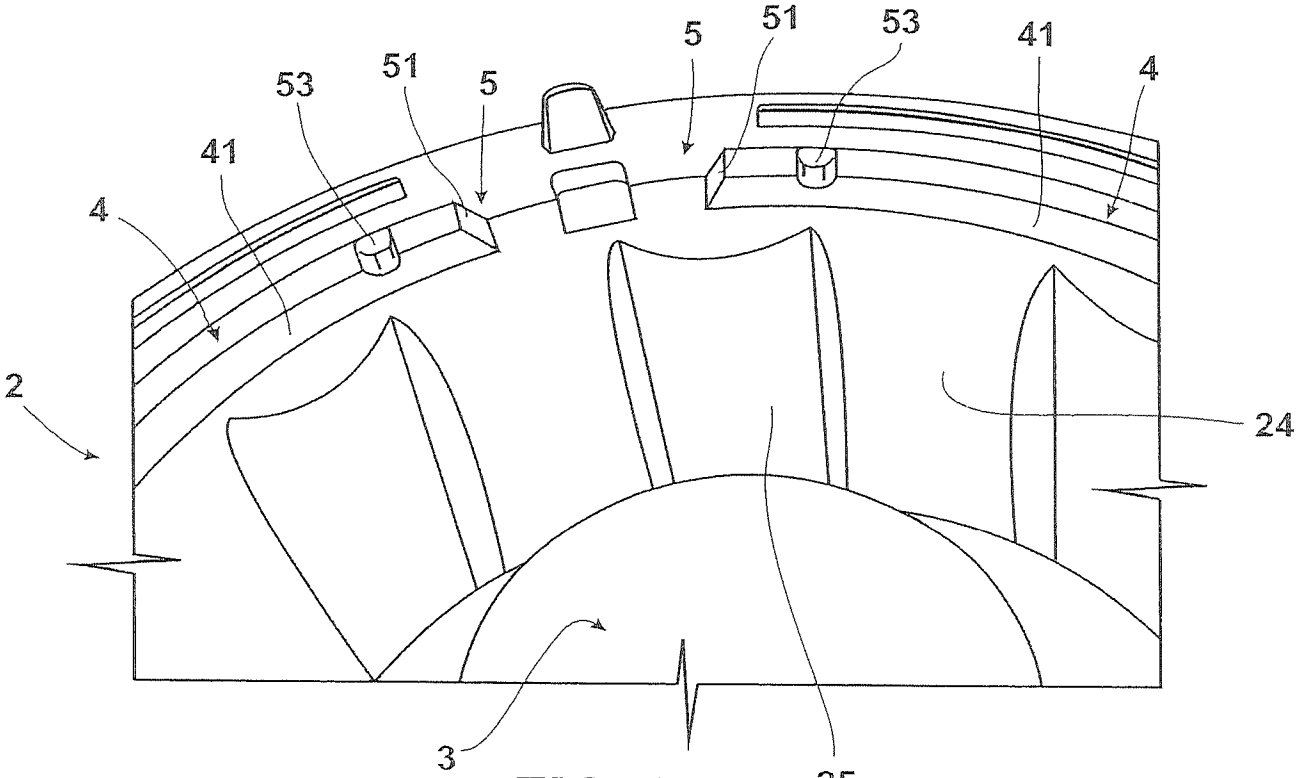

Moreover, the external structure (2) is linked with the internal structure (1) through a rotating assembly (4) that can offer different variations [as can be appreciated in FIG. 17].

In one embodiment, the rotating assembly (4) can be composed of upper members (15) ending in extremities (16). These extremities (16) are equipped with fixed sliders (40) that are arranged into contact with mobile sliders (41).

In other embodiments, fixed sliders (40) can be in an intermediate part of the internal body (10), be horizontal or inclined, extend between the intermediate part and the upper part or even be in the lower part. The same occurs with mobile sliders (41) that, in consistency with the arrangement of the fixed sliders (40), can be in the upper part of the external body (20), be horizontal or inclined, extend between the intermediate part and the upper part or even be in the lower part.

Although the rotating assembly (4) allows that the external structure (2) rotates regarding the internal structure (1), this rotation movement is limited by the presence of a rotation limiter device (5). This last one includes some fixed ends (50) of the internal structure (1) against which some mobile ends (51) of the external structure (2) act.

In different variations, the fixed ends (50) can be arranged adjacent to the fixed sliders (40), as limiters of the mobile sliders (41) race, at which ends the mobile ends (51) are placed.

The rotation limiter device (5) can also include some forced couplings (52,53) that allow the obtaining of a positional fixing of the external structure (2), at the limit positions of its rotating race. Fixes forced couplings (52) can be in the upper, intermediate or lower part of the internal structure (1), while the mobile forced couplings (53) can be in the upper, intermediate or lower part of the external structure (2).

Figure 15:
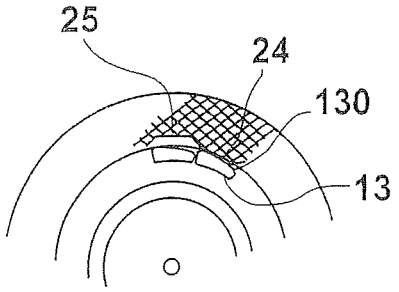
Figure 16:
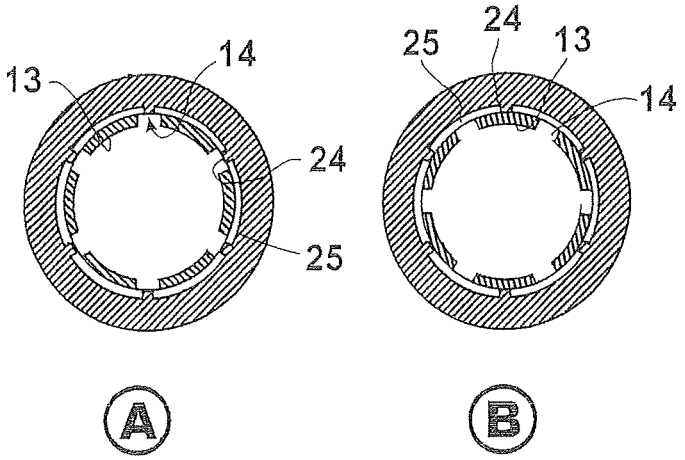

Many variations have been foreseen—such as can be appreciated in FIGS. 1, 15, 18 and 19—that include sets of incomings and outgoings which coupling is produced by forcing. In the variations of FIG. 15, it can be observed that the mobile forced couplings (53) can be in the upper edge (21) and/or lower edge of the extremities (16) of the upper members (15). Instead, fixed forced couplings (52) can be in the upper edge (21) of the external body (20) and/or in the upper wall (23) of the external structure (2).

In this manner, the rotation ends (50,51) determine that the external structure (2) can rotate in one direction until a limit, in which the mobile blocking members (24) are active behind the grip fingers (13), in such a way that these last ones (13) act below the annular cordon (61) or annular protrusion (62) of the container (6).

The other ends (50,51) of opposite rotations, determine that the external structure (2) can rotate in the opposite directions until the opposite limit, in which the mobile blocking members (24) remain passive in the intermediate spaces (14) and the grip fingers (13) can elastically move back, up to the unblocking cavities (25). This elastic setback allows the extraction of the safety lock of the container mouth (6).

In each rotation limit position, the external positional fastening means (52,53), in this case forced couplings (53, 53), allow the immobilization of the external structure (2) in these positions.

The handling of the lock is done using an external structure (2) as command grip. This external structure (2) includes the upper wall (23) with which it is related through the respective lower (81) and upper (80) couplings that, formed by their respective walls, can be of the forced fit type.

The possibility of incorporating a safety system of the type of a seal that links the upper wall (23) of the external structure (2) with the internal structure (1) has also been foreseen In this way, the rotating capacity of the external structure (2) is limited by the rotation limiter device (5) and by a unidirectional rotation mechanism (73), that allows rotation in the direction of blocking but that prevents rotation in the opposite directions. This mechanism (73) includes an upper tooth (74) that is placed in a detachable sector (70) of the upper wall or lock (23) of the external structure (2). The mentioned upper tooth (74) engages in unidirectional form—that is, in only one of the rotation directions—with the lower tooth (75) placed in the internal structure (1).

Said internal structure (1) includes an internal body (10) from which both the grip fingers and the lower tooth (75) are projected. The possibility of including a supporting central body (10*a*) that assembled in said internal body (10), on the one hand, provides a retentive supporting member (11) for the cap (3), while on the other hand, allows the link with the upper wall (23) through the link member (76), has been foreseen.

On the other hand, above-mentioned detachable sector (70) is linked to the mentioned upper wall (23) through a sectorial weakening (71) that eases its detachment through pressure and sinking.

In one embodiment [see drawing B of FIG. 1, drawing B of FIG. 2, FIG. 4, FIG. 7 and FIG. 8], the detachable sector (70) of the upper wall (23) shows a central weakening (72) through which it is linked to a link member (76) that projects from the internal structure (1).

Figure 24:
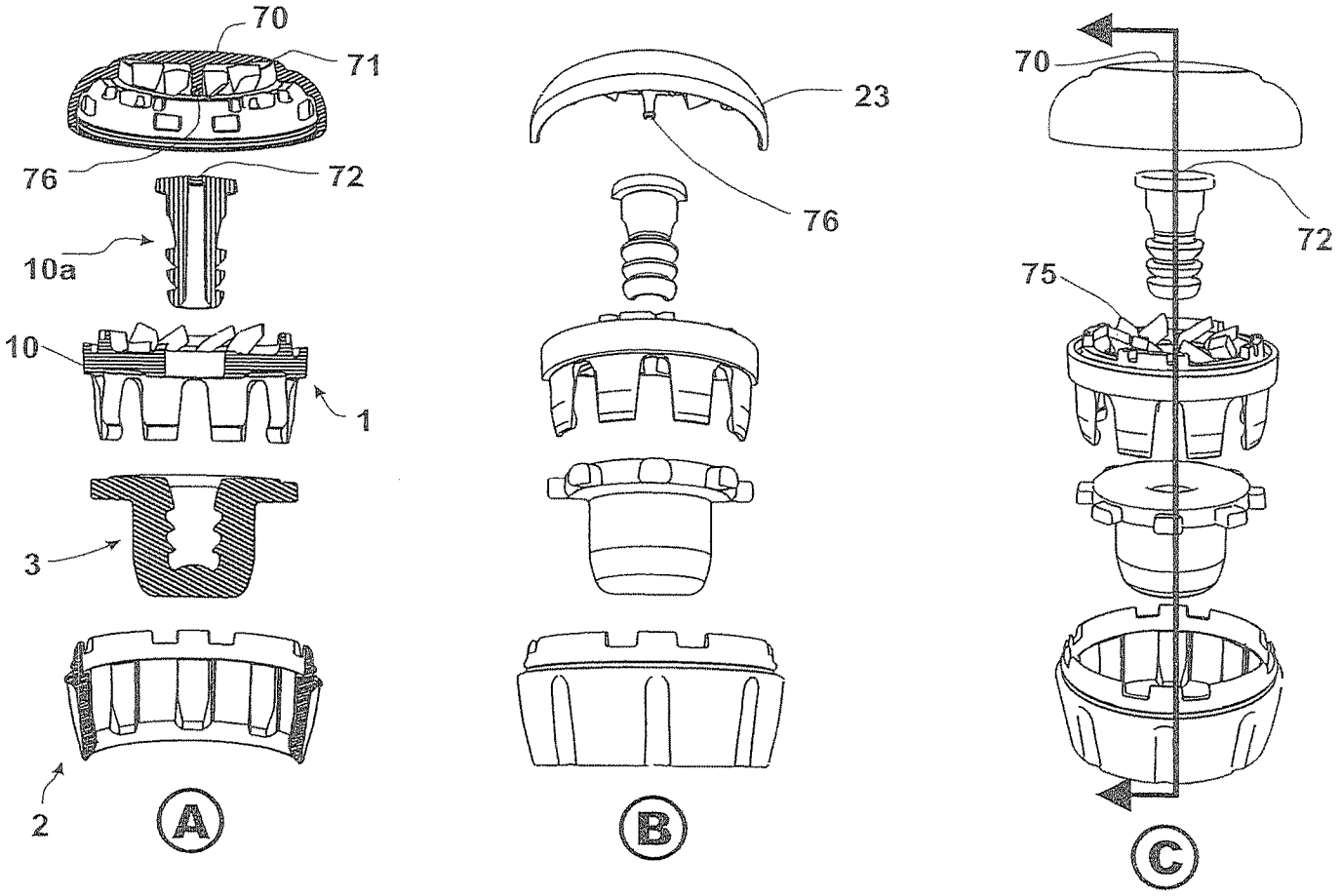
Figure 25:
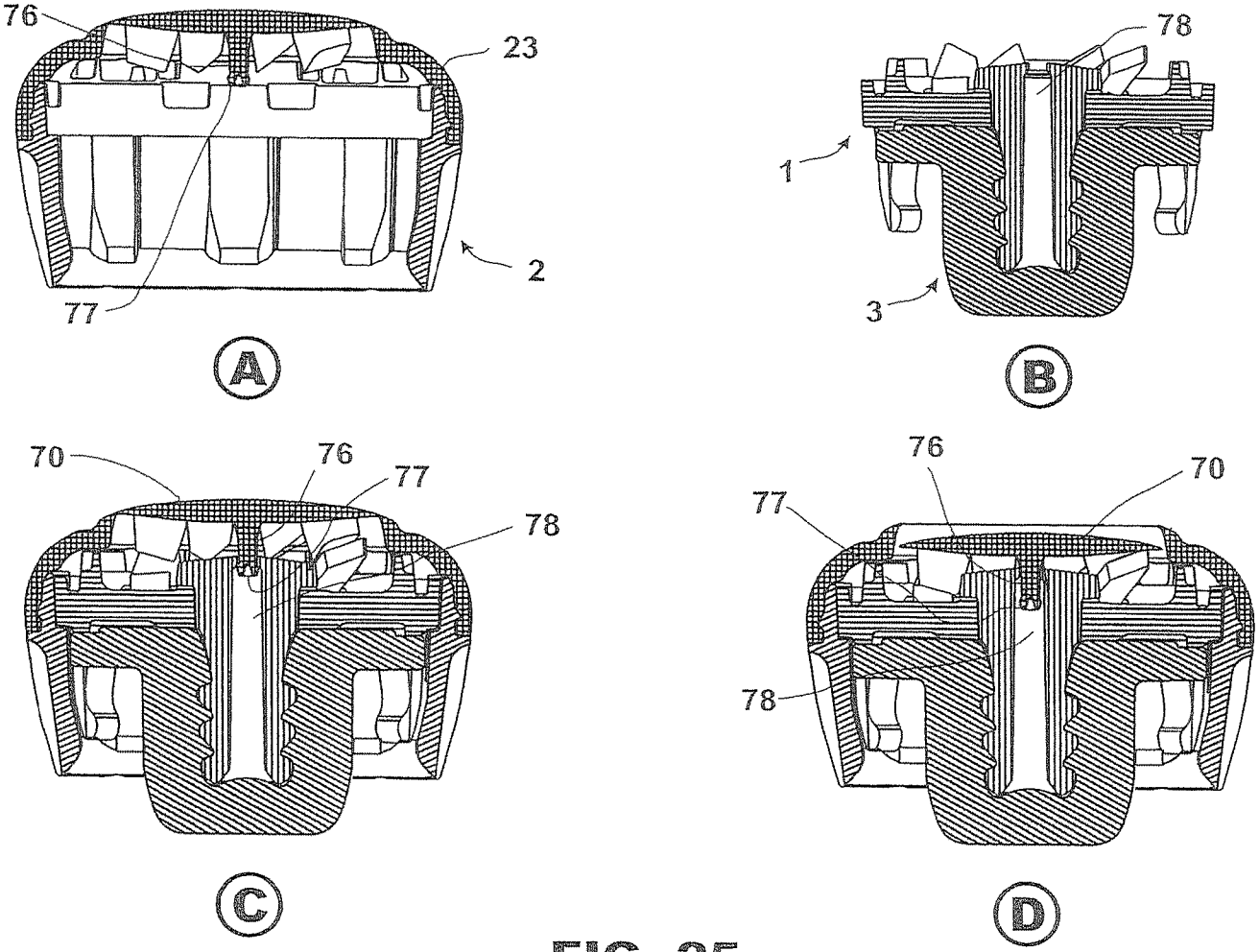
Figure 26:
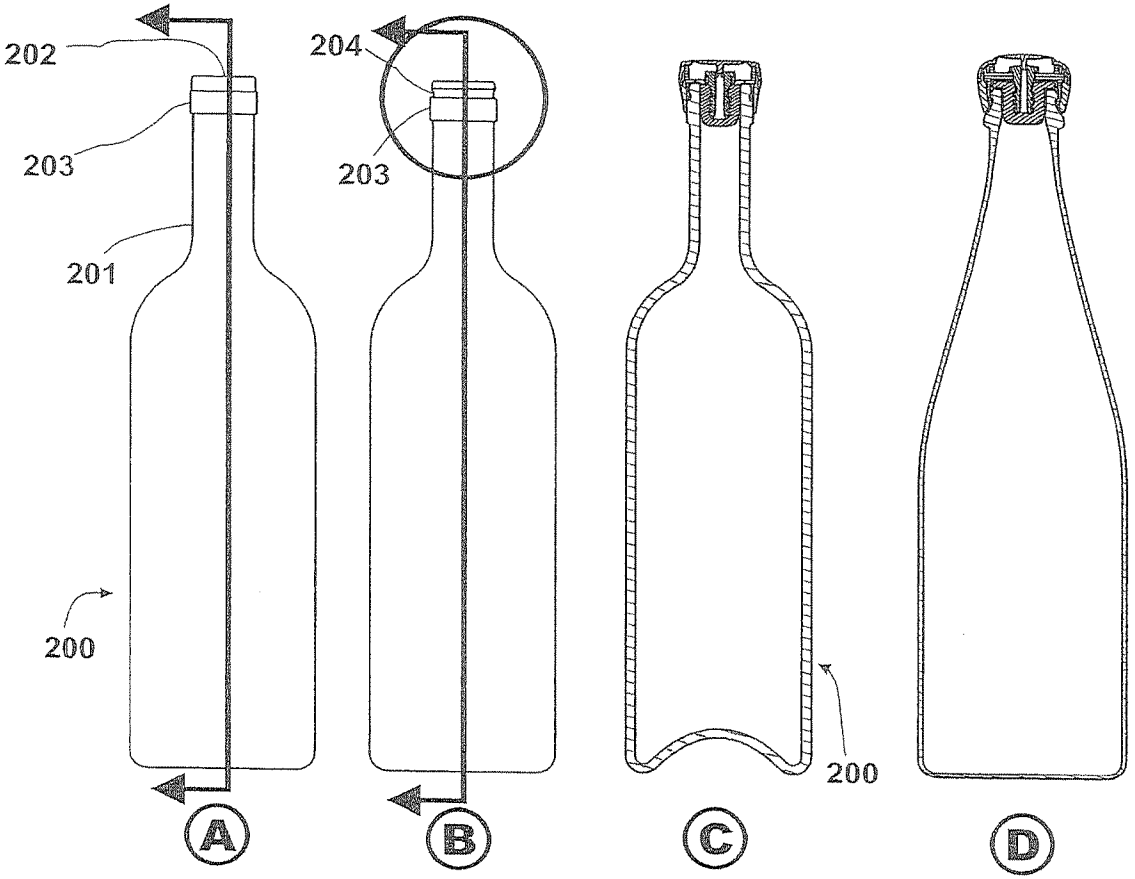

In another embodiment [see FIGS. 24 and 25], the link member (76) is projected from the detachable sector (70) in the upper wall (23) to finish in a sinkable extremity (77) that links it detachably in a sinking opening (78) provided by the internal structure (1). In both embodiments, the detachable sector (70) acts as a safety seal and, even after being detached, the link member (76) maintains it as cover of the lock upper part.

Operation:

As the present safety lock only operates through rotation movements to the opposite sides, to be placed in a container (6), it should be rotated until the limit in which the mobile blocking members (24) are passive in the intermediate spaces (14) and the grip fingers (13) can elastically move back to the unblocking cavities (25).

In this manner, upon placing the safety lock in the opening (63) of the container (6), the grip fingers (13) elastically yielding allow exceeding the position of the annular cordon (61) or of the annular protrusion (62). The associative linking between the internal structure (1) and the cap (3) determines that, at the same time, the cap (3) closes said opening (63) of the container (6).

Once the safety lock is positioned with its internal structure (1) immobilized by the cap (3), the external structure (2) can rotate in the opposite direction to that of the opening until the limit, in which the mobile blocking members (24) are active behind the grip fingers (13) in a way that these last ones (13) are hold below the annular cordon (61) or annular protrusion (62) of the container (6).

In all cases, when reaching the limit rotation positions, the forced couplings (52,53) that positionally immobilize the external structure (2) regarding the internal structure (1) act.

In the cases in which the safety lock (7) is used, the initial operation is the same. However, to open and close again, it is necessary to push and sink the detachable sector (70) that acts as seal until it is detached from the upper wall (23). In these conditions, the unidirectional rotation mechanism (73) stops acting over the upper wall (23) and, consequently, over the external structure (2), and therefore this last one can freely rotate in both directions to get the lock of the neck (201) of the bottle (200) of application in and out.

Bottle:

A bottle (200) was developed specifically for this safety lock. It has an annular clamping entrance (204) that, being compatible with the grip position of the safety lock, it is interposed between the discharge mouth (202) and the annular cordon (203) of the neck (201).

Undoubtedly, upon putting the present invention into practice, modifications may be introduced regarding certain construction details and folio, without leaving the essential principles that are clearly explained in the claims below.

The invention claimed is:

1. A short rotation safety lock for a container having an opening surrounded by an annular protrusion, the short rotation safety lock comprising:

an internal structure that fits into the opening of the container, an external structure comprising a rotatable body rotating about the internal structure, a rotation assembly linking the internal structure to the external structure and allowing the external structure to rotate about the internal structure;

mobile blocking members, wherein the internal structure comprises:

a clamping frame configured to clamp the internal structure to the container, the clamping frame comprising grip fingers that are elastically deformable and capable of clamping to the annular protrusion of the container, wherein the mobile blocking members act behind the grip fingers so as to release or hold them against the annular protrusion of the container:

a lock cap configured to forcibly fit in the opening of the container, the lock cap being linked to the clamping frame formed by the grip fingers that are alternated with intermediate spaces;

wherein the rotating assembly comprises a rotation limiter device that limits rotation movement of the external structure about the internal structure to a rotation capacity, and wherein the rotation movement of the external structure determines the movement of the mobile blocking members between an active position behind said grip fingers and a passive position in said intermediate spaces.

2. The short rotation safety lock for containers according to claim 1, wherein the external structure includes a safety seal placed in its upper wall and that locks the rotation limiter device.

3. The short rotation safety lock for containers according to claim 1, wherein the rotation capacity of the external structure is limited by the rotation limiter device and by a unidirectional rotation mechanism that limits the rotation to a blocking direction, wherein the unidirectional rotation mechanism includes a safety device that maintains the unidirectional rotation mechanism active until a deactivation of the safety device enables rotation in both rotation directions of the external structure.

4. The short rotation safety lock for containers according to claim 3, wherein the safety device includes an annular link between the external structure and the internal structure.

5. The short rotation safety lock for containers according to claim 3, wherein an upper wall of the external structure incudes a detachable sector that forms the unidirectional rotation mechanism.

6. The short rotation safety lock for containers according to claim 4, wherein the annular link includes a member that is projected from the internal structure to a detachable sector of the external structure.

7. The short rotation safety lock for containers according to claim 4, wherein the annular link includes a member that is projected from a detachable sector of an upper wall of the external structure to the internal structure.

8. The short rotation safety lock for containers according to claim 1, wherein the internal structure includes a main body that forms the clamping frame where the grip fingers and intermediate spaces that surround a projection of the lock cap alternate, and on a side opposite to the grip fingers upper members project and form, with the external structure, the rotating assembly and the rotation limiter device.

9. The short rotation safety lock for containers according to claim 8, wherein the upper members include respective double extremities.

10. The short rotation safety lock for containers according to claim 8, wherein the main body of the internal structure includes an internal support of the lock cap.

11. The short rotation safety lock for containers according to claim 10, wherein the internal support of the lock cap includes a forced fit internal frame comprising a plurality of retentive supporting members of the lock cap.

12. The short rotation safety lock for containers according to claim 1, wherein the internal structure includes a main body that, forms the clamping frame in which the grip fingers and the intermediate spaces that surround a projection of the lock cap are alternated, and on a side opposite to the grip fingers upper members project and form, with the external structure, the rotation limiter device.

13. The short rotation safety lock for containers according to claim 1, wherein the rotating assembly is between the internal structure and the external structure is in an upper part of the internal structure opposite the clamping frame.

14. The short rotation safety lock for containers according to claim 1, wherein the rotating assembly is between the internal structure and the external structure and is in an intermediate position between an upper part and a lower part of the internal structure.

15. The short rotation safety lock for containers according to claim 1, wherein the rotating assembly is between the internal structure and the external structure and is in the lower part of the internal structure adjacent to the clamping frame.

16. The short rotation safety lock for containers according to claim 1, wherein the rotation limiter device includes:

at least one set of rotation ends formed in the internal structure and/or the external structure, wherein:

one of said rotating ends determines that the external structure can rotate in one direction until a limit in which the mobile blocking members are active behind the grip fingers and another rotation end determines that the external structure can rotate in the opposite direction until an opposite limit in which the mobile blocking members are passive in the intermediate spaces.

17. The short rotation safety lock for containers according to claim 1, wherein the rotation limiter device includes:

at least one set of rotation ends formed in the internal structure and/or the external structure, wherein:

one of said rotation ends determines that the external structure can rotate in one direction until a limit in which the mobile blocking members are active behind the grip fingers, another rotation end determines that the external structure can rotate in the opposite direction until an opposite limit in which the mobile blocking members are passive in the intermediate spaces, and extreme positional fastening means are formed adjacent to each rotation end.

18. Short rotation safety lock for containers, according to claim 17, wherein the extreme positional fastening means include forced couplings.

19. The short rotation safety lock for containers according to claim 1, wherein the rotation limiter device includes:

at least one set of rotation ends arranged in the rotating external structure, wherein the at least one set of rotation ends act against at least one fixed member provided by the internal structure, one of said rotation ends determines that the external structure can rotate in one direction until a limit in which the mobile blocking members are active behind the grip fingers and another rotation end determines that the external structure can rotate in the opposite direction until an opposite limit in which the mobile blocking members in the intermediate spaces.

20. The short rotation safety lock for containers according to claim 1, wherein the rotation limiter device includes:

at least one set of rotation ends arranged in the internal structure, wherein the at least one set of rotation ends act against at least one fix member provided by the rotating external structure, one of said rotation ends determines that the external structure can rotate in one direction until a limit in which the mobile blocking members are active behind the grip fingers and another rotation end determines that the external structure can rotate in the opposite direction until an opposite limit in which the mobile blocking members are passive in the intermediate spaces.

21. The short rotation safety lock for containers according to claim 1, wherein the grip fingers are elastically yielding.

22. The short rotation safety lock for containers according to claim 21, wherein the elastically yielding grip fingers are usually open relative to the annular protrusion of the application container.

23. The short rotation safety lock for containers according to claim 21, wherein the elastically yielding grip fingers are usually closed relative to the annular protrusion of the application container.

24. The short rotation safety lock for containers according to claim 1, wherein the lock cap includes:

a shutter linked to the internal structure, wherein the shutter comprises a hollow body configured to fit tightly into the opening of the container, wherein the hollow body has an internal lock having at least one passage where the hollow body communicates with an internal cavity of the container, and the passage allows the entering of gases that exert expansive and contributing forces of the cap lock.

25. A bottle comprising an annular entrance compatible with a grip position of the short rotation safety lock of claim 1, wherein the short rotation safety lock is interposed between a discharge mouth of the bottle and an annular protrusion of a neck of the bottle.

* * * * *